United States Patent [19]

LaBrosse et al.

[11] Patent Number: 4,684,552

[45] Date of Patent: Aug. 4, 1987

[54] PREFABRICATED BOW FORM FOR A POM BOW

[75] Inventors: Paul R. LaBrosse, South St. Paul; Daniel P. Pohl, Grant Township, Washington County both of Minn.

[73] Assignee: Minnesota Mining & Manufacturing Company, St. Paul, Minn.

[21] Appl. No.: 864,829

[22] Filed: May 19, 1986

[51] Int. Cl.[4] ..... D04D 7/10

[52] U.S. Cl. ..... 428/4; 223/46; 428/198

[58] Field of Search ..... 428/4–5, 428/198; 223/46

[56] References Cited

U.S. PATENT DOCUMENTS

| | | | |
|---|---|---|---|
| 3,632,464 | 1/1972 | Grikis | 428/4 |
| 3,637,455 | 1/1972 | Pearson et al. | 428/4 |
| 3,954,212 | 5/1976 | Bolis | 428/4 X |
| 4,329,382 | 5/1982 | Truskolaski et al. | 428/4 |
| 4,449,652 | 5/1984 | Coppins et al. | 428/4 X |
| 4,476,168 | 10/1984 | Aoyama | 428/4 |
| 4,515,837 | 5/1985 | Cheng | 428/4 |

*Primary Examiner*—Henry F. Epstein

*Attorney, Agent, or Firm*—Donald M. Sell; James A. Smith; Leland D. Schultz

[57] ABSTRACT

A prefabricated bow form for a Pom bow comprising two opposed bow ribbons with tie ribbons therebetween, with first ends of the bow and tie ribbons bonded together, and with the bow ribbons bonded together at spaced bonded areas to define fold lines about which the bow ribbons will fold when a bow is formed by gathering the bonded areas adjacent the first ends of the ribbon. The fold lines include adjacent fold lines at right angles to the longitudinal edges of the bow ribbons that define therebetween generally central loop forming portions on the bow ribbons, and spaced angled fold lines between the central portions and both ends of the bow ribbons forming additional loop forming portions adjacent both ends of the bow ribbons.

5 Claims, 7 Drawing Figures

PREFABRICATED BOW FORM FOR A POM BOW

TECHNICAL FIELD

This invention relates to prefabricated bow forms for Pom bows.

BACKGROUND ART

Several U.S. Patents including U.S. Pat. Nos. 3,637,455; 3,954,212; 4,329,382; 4,476,168 and 4,515,837 have described prefabricated bow forms of the type comprising two bow ribbons disposed in opposed relationship, and at least one pull string or tie ribbon (called tie ribbon hereinafter) disposed centrally between the bow ribbons, with first ends of the bow and tie ribbons bonded together, and the bow ribbons being bonded together at a plurality of spaced bonded areas adjacent both longitudinal edges of the tie ribbon so that the tie ribbon is unbonded to the bow ribbons but is constrained between the bow ribbons. The spaced bonded areas define lines extending across the bow ribbons about which the bow ribbons will fold to form loops when the bonded areas of the bow ribbons are gathered together adjacent the first ends of the bow ribbons, which gathering is done either by pushing the bonded areas farthest from the first ends toward the first ends while the tie ribbon is held by its second end, by pulling on the second end of the tie ribbon while the bow ribbons are held adjacent the bonded areas closest to their second ends, or a combination of such pushing and pulling.

Of the patents described above, U.S. Pat. Nos. 3,637,455; 3,954,212; and 4,515,837 have described such prefabricated bow forms specifically intended to, form a Pom bow (which may be called a pompom bow or a pompon bow by some), which is a generally hemispherically shaped bow defined by a plurality of loops of generally the same length generally evenly distributed about and projecting from a center of the bow radially outwardly and progressively upwardly toward the top of the bow to define a generally hemispherical periphery with no visually significant open areas.

The bow ribbons in the prefabricated bow forms for Pom bows described in those patents, however, have been notched to facilitate positioning the loops in the radial and upward pattern to form the desired hemispherical Pom shape, which positioning typically required manual manipulation of the loops after they were formed. Also, such notching added expense to making the bow form and restricted the width of the tie ribbon that could be used in the bow form.

U.S. Pat. No. 4,476,168 describes a prefabricated bow form that is closest in its structural features to the prefabricated bow form described herein in that it describes unnotched bow ribbons bonded together at spaced bonded areas with relatively wide tie ribbons therebetween, which tie ribbons can be tied or adhered around an item such as a package to which a bow made from the bow form is to be attached; and describes the use of such spaced bonded areas to define a combination of fold lines extending both normal to and at acute angles to the edges of the bow ribbons, with triangular sections of the ribbons between some of such differently oriented fold lines to cause loops to orient in different angular relationships radially of the bow formed with the bow form. The bows formed by the prefabricated bow forms described in that patent, however, either have loops positioned directly above each other in the form of a cross (FIG. 6) which is not a desired shape for a Pom bow, or have four loops at right angles to each other with loops above and below bisecting the angle formed between opposing loops (FIG. 13) which forms a bow that, while perhaps having its own appeal, also does not have the shape of a conventional Pom bow.

DISCLOSURE OF THE INVENTION

The present invention provides a prefabricated bow form which both forms a bow having the shape of a conventional Pom bow described above using unnotched bow ribbons, and can include at least one and preferably two tie ribbons having a width only slightly less than the widths of the bow ribbons which form the bow, by which tie ribbons the bow can be tied to an object or package.

The prefabricated bow form for a Pom bow according to the present invention comprises two bow ribbons of a first width disposed in opposed relationship, and at least one tie ribbon disposed centrally between the bow ribbons. Aligned first ends of the bow and tie ribbons are firmly bonded together, and the bow ribbons are bonded together at a plurality of spaced bonded areas adjacent both longitudinal edges of the tie ribbon so that the tie ribbon is unbonded to the bow ribbons but constrained between the bow ribbons. Those spaced bonded areas define imaginary fold lines extending across the bow ribbons about which the bow ribbons will fold when the bow is formed by gathering the bonded areas adjacent the first ends. The fold lines defined by the bonded areas include spaced adjacent fold lines generally at right angles to the longitudinal edges of the bow ribbons which define therebetween a generally central loop forming portion on each of the bow ribbons, and spaced fold lines between the central portion and both ends of the bow ribbons disposed at acute included angles with the longitudinal edges of the bow ribbons with the acute included angles with respect to each longitudinal edge being alternately disposed adjacent and opposite the first end. The fold lines between the central portions and the second ends of the bow ribbons form at least two (and preferably four) loop forming portions on each of the bow ribbons and the fold lines between the central portion and the first ends together with the bond at the first ends of the ribbons form at least three (and preferably four) loop forming portions on each of the bow ribbons. Also, the fold lines at acute included angles adjacent the fold lines at right angles form generally triangular portions on each of the bow ribbons at both ends of the central loop forming portion.

This prefabricated bow form structure can form a very full Pom bow including two opposed loops formed from the central loop forming portions, and loops both above and below those two opposed loops formed by the portions of the bow ribbons between its central portion and ends that project radially outwardly from the center of the bow at different angles with respect to those opposed loops and with those opposed loops progressively project more upwardly starting from the loops formed adjacent the second ends of the bow ribbons to define the generally hemispherical shape for the bow.

Also, preferably the prefabricated bow form for a Pom bow includes two superimposed contacting tie ribbons having widths generally in the range of only about $\frac{1}{4}$ to $\frac{3}{8}$ inch less than the widths of the bow ribbons. Two tie ribbons of such width can be secured around an item or package to which the formed Pom bow is applied, which can be a convenience and can add to the attractiveness of the item or package.

BRIEF DESCRIPTION OF THE DRAWING

The present invention will be more thoroughly described with reference to the accompanying drawing in which like numbers refer to like parts in the several views, and wherein.

DESCRIPTION OF THE PREFERRED EMBODIMENT

Figure 1:
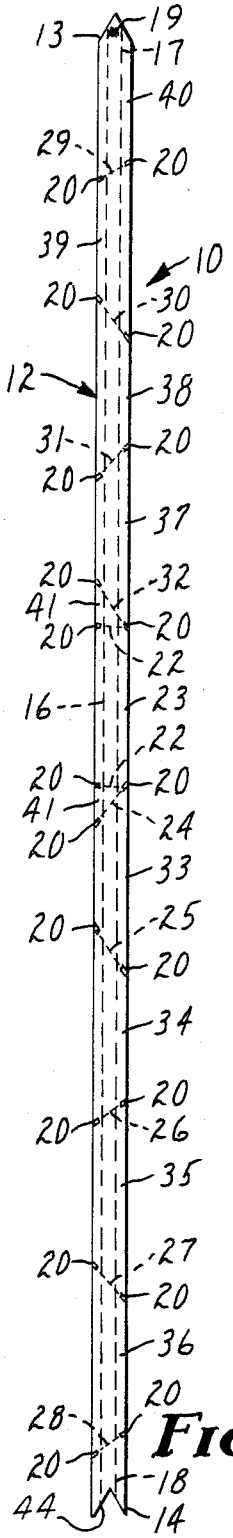
FIG. 1 is a plan view of a prefabricated bow form for Pom bows according to the present invention.
Figure 2:
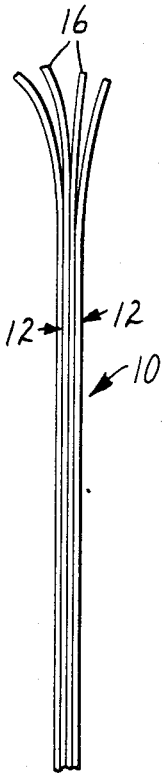
FIG. 2 is an enlarged fragmentary edge view of the prefabricated bow form of FIG. 1.
Figure 3:
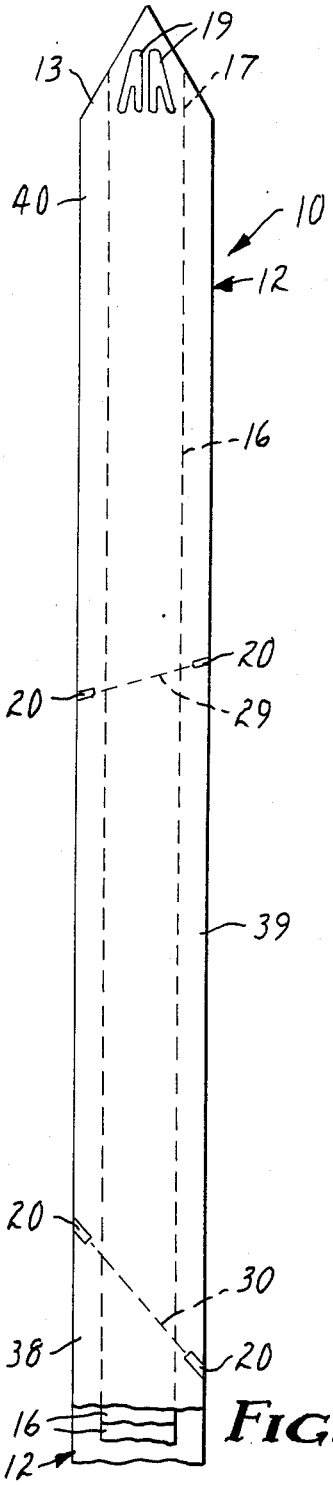
FIG. 3 is an enlarged fragmentary view of the prefabricated bow form of FIG. 1.

Referring now to FIG. 1 of the drawing, there is shown a prefabricated bow form for a Pom bow according to the present invention, generally designated by the reference numeral 10.

Figure 4:
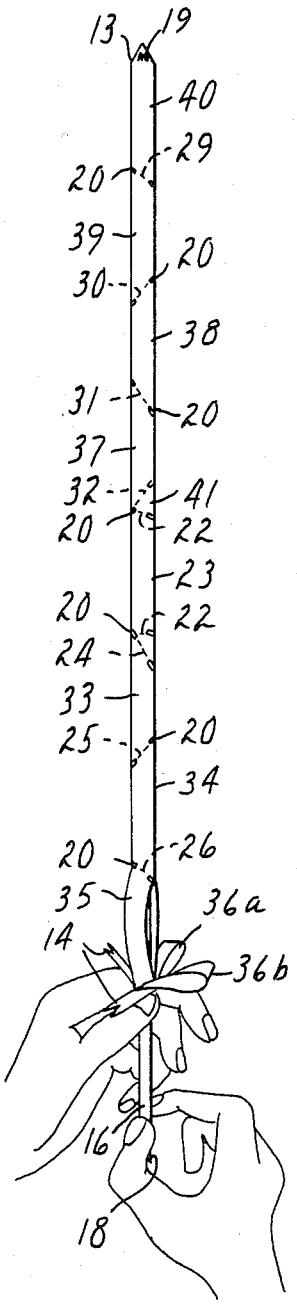
FIG. 4 is a perspective view illustrating the prefabricated bow form of FIG. 1 being changed into a bow.

Generally, like prior art prefabricated bow forms the prefabricated bow form 10 for a Pom bow comprises (1) two bow ribbons 12 of a first width having first and second ends 13 and 14 and disposed in opposed relationship; and (2) at least one, and as illustrated, preferably two tie ribbons 16 having first and second ends 17 and 18 and being disposed centrally between the bow ribbons 12. The first ends 13 and 17 of the bow and tie ribbons 16 are firmly bonded together by heat bonding at a generally arrowhead shaped end bond 19 formed by making two side by side generally V-shaped bonds, and the bow ribbons 12 are similarly bonded together at a plurality of spaced rectangular bonded areas 20 adjacent both longitudinal edges of the tie ribbons 16 so that the tie ribbons 16 are unbonded to the bow ribbons 12 but are constrained between the bow ribbons 12. The spaced bonded areas 20 define fold lines extending across the bow ribbons 12 about which the bow ribbons 12 will fold to form loops and a bow 21 when the bonded areas 20 of the bow ribbons 12 are gathered together adjacent the first ends 13 and 17 of the bow and tie ribbons 12 and 16. The fold lines cannot be seen on the bow form 10, but have been illustrated as dotted lines in the drawing to facilitate understanding of the present invention. As is illustrated in FIG. 4, such gathering of the bonded areas 20 at the first ends 13 and 17 to form the bow 21 is done either by pushing the bonded areas 20 farthest from the first ends 13 and 17 toward the first ends 13 and 17 while the tie ribbons 16 are held by their second ends 18, by pulling on the second ends 18 of the tie ribbons 17 while the bow ribbons 12 are held adjacent the bonded areas 20 adjacent their second ends 14, or a combination of such pushing and pulling.

In the present invention, these fold lines defined by the bonded areas 20 include spaced adjacent right angle fold lines 22 generally at right angles to the longitudinal edges of the bow ribbons 12 and defining therebetween a generally central loop forming portion 23 on each of the bow ribbons 12, and spaced acute angle fold lines 24 through 32 between the central portion 23 and both ends 13 and 14 of the bow ribbons 12 disposed at acute included angles with the longitudinal edges of the bow ribbons 12 with the acute included angles with respect to each longitudinal edge being alternately disposed adjacent and opposite the first ends 13. The acute angle fold lines 24, 25, 26, 27, and 28 between the central portions 23 and the second ends 14 of the bow ribbons 12 form at least two loop forming portions and, as illustrated, preferably four loop forming portions 33, 34, 35 and 36 on each of the bow ribbons 12, and the acute angle fold lines 29, 30, 31, and 32 between the central portion 23 and the first ends 13 and 17 together with the end bond 19 form at least three, and as illustrated, preferably four loop forming portions 37, 38, 39 and 40 on each of the bow ribbons 12. Also, the acute angle fold lines 24 and 32 adjacent the right angle fold lines 22 form generally triangular portions 41 on each of the bow ribbons 12 at both ends of the central loop forming portion 22 that form special functions in shaping the bow 21 as will later be described.

The spaced acute angle fold lines 24 through 32 between the central portions 23 and both ends 13 and 14 of the bow ribbons 12 are disposed at acute included angles in the range of 20 to 80 degrees with the longitudinal edges of the bow ribbons 12; and as an example developed by much experimentation for $\frac{7}{8}$ inch wide ribbon, the spaced acute angle fold lines 29, 30, 31 and 32 between the central portions 23 and the first ends 13 of the bow ribbons 12 are disposed sequentially starting from the central portions 23 at acute included angles of about 35, 40, 40 and 70 degrees with respect to one edge of the bow ribbons 12; and the spaced fold lines 24, 25, 26, 27 and 28 between the central portions 23 and the second ends 14 of the bow ribbons 12 are disposed sequentially starting from the central portions 23 at acute included angles of about 35, 40, 55, 55 and 35 degrees with respect to one edge of the bow ribbons 12.

Preferably two tie ribbons 16 have widths generally in the range of about $\frac{1}{4}$ to $\frac{3}{8}$ inch less than the widths of the bow ribbons 12, which provides sufficient edge margins on the bow ribbons 12 projecting past the longitudinal edges of the tie ribbons along which the bonded areas 20 between the bow ribbons 12 may be formed.

The end bond 19 and bonded areas 20 are preferably formed by heat bonding portions of the bow ribbons 12 together. The end bond and bonded areas could also be formed by many other means, however, such as by the use of suitable hot melt or other adhesives, or by the use of mechanical bonding devices such as metal or plastic clips.

The first ends 13 and 17 of the bow and tie ribbons 12 and 16 preferably have a pointed shape, and the second ends 14 and 18 preferably have a V-shaped notch 44 that is both decorative and compliments the pointed shape of the first ends 13 and 17 so that the bow form 10 can be formed from continuous lengths of ribbon that are heat bonded together and cut apart with one V-shaped cut.

The bow and tie ribbons 12 and 16 are preferably formed from Sasheen TM brand ribbon available from Minnesota Mining and Manufacturing Company (3M), St. Paul, Minn. Sasheen TM brand ribbon has a nonwoven structure comprising longitudinally extending closely adjacent parallel acetate filaments providing its front surface and adhered to a layer of randomly arrayed polyester fibers that define its back surface. Such ribbon provides an attractive appearance and affords the use of heat bonding to form the end bond 19 and bonded areas 20. Other ribbon materials such as Decasheen TM brand ribbon which comprises unoriented pigmented polyethylene and which is also available from 3M can also be used, however, and may be preferred for certain purposes.

Figure 5:
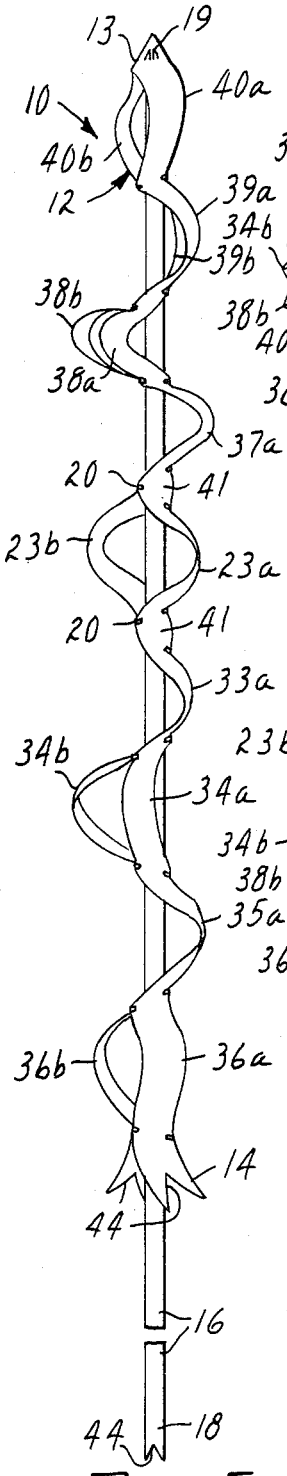
FIG. 5 is an enlarged perspective view showing positions that loop forming portions of the prefabricated bow form of FIG. 1 move through as the bow form is changed into a bow.

FIG. 5 illustrates intermediate positions that the loop forming portions 23 and 33 through 40 and the triangular portions 41 pass through as the bow 21 is formed from the bow form 10. In forming the bow 21, the intermediate positions illustrated in FIG. 5 are moved through sequentially along the bow form 10 rather than at the same time as illustrated, however, FIG. 5 serves to illustrate the effect the fold lines 22 and 24 through 32 have in shaping the bow 11 as it is formed. To facilitate understanding that shaping effect, in FIGS. 5, 6 and 7 (and to a limited extent in FIG. 4) the loop forming portions 23 and 33 through 40 and the triangular portions 41 on the two bow ribbons 12 have been given the suffix "a" on one bow ribbon 12 and the suffix "b" on the other bow ribbon 12.

Figure 6:
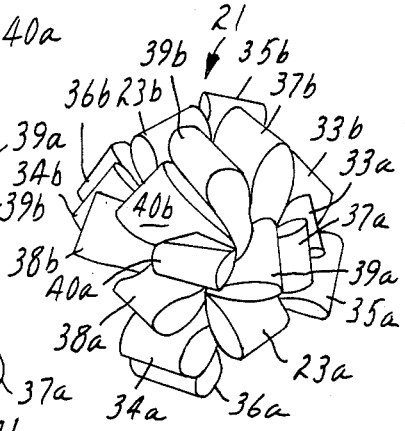
FIG. 6 is a top view of a bow formed from the prefabricated bow form of FIG. 1.
Figure 7:
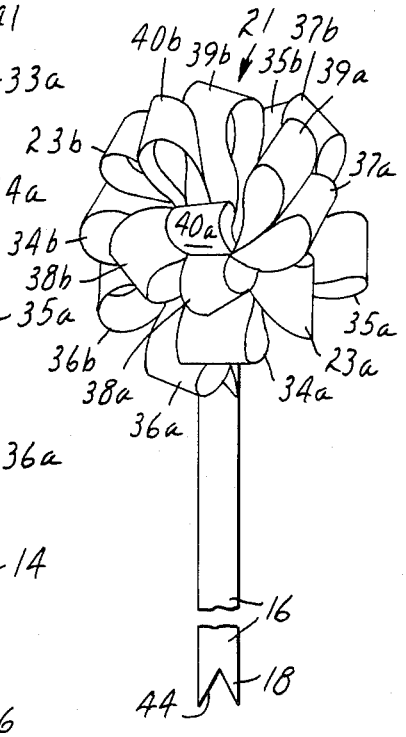
FIG. 7 is a fragmentary perspective view of the fow formed from the prefabricated bow form of FIG. 1.

As can be seen from FIGS. 5, 6 and 7, the bow form 10 can form a very full Pom bow 21 including two opposed loops 23*a* and 23*b* formed from the central loop forming portions 23, and loops both above and below those two opposed loops 23*a* and 23*b* formed by the loop forming portions 33 through 40 of the bow ribbons 12 between their central loop forming portions 23 and their ends 13 and 14 that project radially outwardly from the center of the bow at different angles with respect to those opposed loops 23*a* and 23*b* and with those opposed loops 23*a* and 23*b* progressively project more upwardly starting from the loops formed adjacent the second ends 14 of the bow ribbons 12 to define the generally hemispherical shape of the bow 21.

Specifically, the forming of the bow 21 proceeds as follows starting from the second ends 14 of the bow ribbons 12. First, as is best seen in FIG. 4, the loop forming portions 36 form loops 36*a* and 36*b* disposed generally at right angles to each other on one side of the tie ribbons 16. Then, as can be seen in FIGS. 5, 6 and 7 (wherein the bow structure 10 is rotated 180 degrees from its position in FIG. 4), loop forming portions 35 form loops 35*a* and 35*b* with loop 35*a* opposite loop 36*b* and loop 36*a* opposite loop 36*b* to form a generally cross shaped base for the Pom bow 21. Next loop forming portions 34 and 33 sequentially form loops 34*a* and 34*b* lying generally above loops 36*a* and 36*b* respectively, and loops 33*a* and 33*b* lying generally above 35*a* and 35*b* respectively. The loop forming portions 23 then form loops 23*a* and 23*b* projecting radially outwardly directly opposite to each other with loop 23*a* bisecting the space between loops 33*a* and 34*a* (and also loops 35*a* and 36*a* below them) and loop 23*b* bisecting the space between loops 33*b* and 34*b* (and also loops 35*b* and 36*b* below them). This position of the opposite loops 23*a* and 23*b* is caused by the change in orientation of the fold lines 22 and 24 defining the triangular portion 41 between them, which triangular portion helps to hold the loops 33*a* and 33*b* close to each other and forms a slight projection that is generally not noticed in the bow 21. Next, loop forming portions 37 and 38 form loops 37*a* and 37*b* which are generally aligned over loops 33*a* and 33*b* respectively because of the orientation of the fold lines 22 and 32 defining the triangular section 41 therebetween (which also folds into a slight unnoticed projection), loop forming portion 38 forms loops 38*a* and 38*b* generally aligned over loops 34*a* and 34*b* respectively, loop forming portion 39 forms loops 39*a* and 39*b* generally. aligned over loops 37*a* and 37*b* respectively; and loop forming portion 40 forms loops 40*a* and 40*b* generally aligned over loops 38*a* and 38*b* respectively. Gathering of the bonded portions 20 at the center of the Pom bow to form such loops causes each loop to progressively project more upwardly starting from the base of the bow formed by the loops 36*a*, 36*b*, 35*a* and 35*b* toward the loops 40*a* and 40*b*. The close packing of the loops, slight differences in the acute angles of the fold lines 24 through 32, and the orienting effect of the triangular sections 41, together with each loop being wider (in a direction normal to the surface of the bow ribbon 12) at the end of the loop that adjacent the bonded areas 20 causes the loops to position themselves in generally evenly distributed closely adjacent positions that form a generally hemispherical periphery for the Pom bow 21 that has no visually significant open spaces, even though some small open spaces occur around the base of the Pom bow 21.

The present invention has now been described with reference to one embodiment thereof. It will be apparent to those skilled in the art that many changes can be made in the embodiment described without departing from the scope of the present invention. For example, as indicated above, acceptable Pom bows can be formed by having at least two (i.e., 2, 3, 4 or more) loop forming portions defined by acute fold lines between the central portions and the second ends of the bow ribbon; and at least three (i.e., 3, 4 or more) loop forming portions defined by acute fold lines between the central portions and the first ends of the bow ribbons. Thus the scope of the present invention should not be limited to the structures described in this application, but only by structures described by the language of the claims and the equivalents of those structures.

I claim:

1. A prefabricated bow form for a pom bow comprising two bow ribbons of a first width having first and second ends and being disposed in opposed relationship, and at least one tie ribbon having first and second ends and being disposed centrally between said bow ribbons, the first ends of said bow and tie ribbons being firmly bonded together, said bow ribbons being bonded together at a plurality of spaced bonded areas adjacent both longitudinal edges of said tie ribbon so that said tie ribbon is unbonded to said bow ribbons but constrained between said bow ribbons, said spaced bonded areas defining fold lines extending across said bow ribbons about which fold lines the bow ribbons will fold when a bow is formed by gathering the bonded areas adjacent said first ends, said fold lines including spaced adjacent fold lines generally at right angles to the longitudinal edges of said bow ribbons and defining therebetween a generally central loop forming portion on each of said bow ribbons, and spaced fold lines between said central portion and both ends of said bow ribbons disposed at acute included angles with the longitudinal edges of said bow ribbons with said acute included angles with respect to each longitudinal edge being alternately disposed adjacent and opposite said first end, said fold lines between the central portions and said second ends of said bow ribbons forming at least two loop forming portions on each of said bow ribbons, and said fold lines between said central portion and said first ends together with said bond at the first ends of said ribbons forming at least three loop forming portions on each of said bow ribbons, and said fold lines at acute included angles adjacent said fold lines at right angles forming generally triangular portions on each of said bow ribbons at both ends of said central loop forming portion.

2. A prefabricated bow form for a Pom bow according to claim 1 including two tie ribbons having widths generally in the range of only about $\frac{1}{4}$ to $\frac{3}{8}$ inch less than the widths of said bow ribbons.

3. A prefabricated bow form for a Pom bow according to claim 1 wherein said fold lines between said central portion and said second ends of said bow ribbons form four loop forming portions on each of said bow ribbons, and said fold lines between said central portion and said first end together with said bond at said first end form four loop forming portions on each of said bow ribbons.

4. A prefabricated bow form for a Pom bow according to claim 1 wherein said spaced fold lines between said central portions and both ends of said bow ribbons are disposed at acute included angles in the range of 20 to 80 degrees with the longitudinal edges of said bow ribbons.

5. A prefabricated bow form for a Pom bow according to claim 4 wherein said spaced fold lines between said central portions and said first ends of said bow ribbons are disposed sequentially starting from said central portions at acute included angles of about 35, 40, 40 and 70 degrees with respect to one edge of said bow ribbons, and said spaced fold lines between said central portions and said second ends of said bow ribbons are disposed sequentially starting from said central portion at acute included angles of about 35, 40, 55, 55, and 35 degrees with respect to said one edge of said bow ribbons.

* * * * *

UNITED STATES PATENT AND TRADEMARK OFFICE

CERTIFICATE OF CORRECTION

PATENT NO. : 4,684,552

DATED : August 4, 1987

INVENTOR(S) : Paul R. LaBrosse and Daniel P. Pohl

It is certified that error appears in the above-identified patent and that said Letters Patent is hereby corrected as shown below:

Col. 3, line 25, "fow" should be -- bow --.

Signed and Sealed this

Fifth Day of April, 1988

*Attest:*

*Attesting Officer*

DONALD J. QUIGG

*Commissioner of Patents and Trademarks*